US006948333B1

(12) United States Patent
Akopyan

(10) Patent No.: US 6,948,333 B1
(45) Date of Patent: Sep. 27, 2005

(54) COMBINED BOTTLES WITH HIDDEN COOLER

(76) Inventor: Arshak Sh. Akopyan, 1215 E. Colorado St., Suite 202B, Glendale, CA (US) 91205

( * ) Notice: Subject to any disclaimer, the term of this patent is extended or adjusted under 35 U.S.C. 154(b) by 0 days.

(21) Appl. No.: 10/827,191

(22) Filed: Apr. 19, 2004

(51) Int. Cl.[7] ..... F25D 3/08
(52) U.S. Cl. ..... 62/457.3; 62/371; 62/457.2
(58) Field of Search ..... 62/457.1, 457.2, 62/457.3, 457.4, 457.5, 530, 371

(56) References Cited

U.S. PATENT DOCUMENTS 4,656,840 A * 4/1987 Loofbourrow et al. ..... 62/530
5,522,239 A * 6/1996 Schwartz et al. ..... 62/457.5
5,806,338 A * 9/1998 Schwartz et al. ..... 62/530
6,209,344 B1 * 4/2001 Mahajan ..... 62/457.3

* cited by examiner

*Primary Examiner*—Melvin Jones

(57) ABSTRACT

The set of combined bottles with hidden cooler is designed to allow to store and cool two different types of beverages at once.

The set contains two interlocked together bottles with handles and a cooling liner. The bottles interlock together by the use of straps. The hidden cooler keeps the beverages in bottles cool for continuous time. The cooler is made from safe for usage material. It is cored and filled with water. This invention allows continuing cooling of the beverages without interfering with the overall look of the bottles.

1 Claim, 3 Drawing Sheets

COMBINED BOTTLES WITH HIDDEN COOLER

CROSS-REFFERENCE TO RELATED APPLICATIONS

U.S. Patent documents

| | | | |
|---|---|---|---|
| 93,001 | Jul., 27, 1869 | Pietsch | |
| 2,526,165 | Jun., 21, 1947 | Smith | |
| 4,485,636 | Dec. 4, 1984 | Hidalgo | 62/430 |
| 4,768,354 | Sep. 6, 1988 | Barnwell | 62/457 |
| 5,269,368 | Dec. 14, 1993 | Schneider et al. | 165/46 |
| 5,299,433 | Apr. 5, 1994 | Harms et al. | 62/457.2 |
| 5,472,274 | Dec. 5, 1995 | Baillie | 366/129 |
| D376,955 | December 1996 | Petrosyan et al. | D7/598 |
| 6,705,110 | Mar. 16, 2004 | Worsham | 62/457.4 |

FIELD OF INVENTION

This invention relates to coolers for beverage bottles, and particularly to portable drink coolers, which use ice as a refrigerant.

BACKGROUND OF THE INVENTION

Possibility to keep and serve beverages in the cooled conditions is a necessity in cases when cooling brings out the best flavor of the beverage.

Most of the time the beverage is being poured into another containers, where the ice is being added to keep the beverage cold. But when the ice starts to melt the beverage becomes diluted.

Large varieties of small portable coolers are now available on market. Some of them may be represented with U.S. Pat. Nos. 5,269,368, 6,705,110. In these examples the bottles are covered with a jacket made from flexible materials, and the freezing fluids or ice are trapped between walls of the cooler. But those coolers aren't commonly used when the design of the bottle is also important for representation.

In the other type of the coolers represented by U.S. Pat. Nos. 93,001; 5,299,433; 5,472,274 The cooling device is located inside of the liquid. But those coolers can't be used inside of the sealed bottles.

The most commonly used method of cooling bottles when the exterior of the bottle is also important is placing the bottle in a bucket full of ice. This method calls for manipulations with a wet bottle, when the ice starts to melt.

BRIEF SUMMARY OF THE INVENTION

The purpose of the invention was to create a set of bottles for storing and chilling different types of beverages at once. The set contains two bottles, cooler for chilling purposes and strips. The bottles are made from glass. They are built with specially designed inner walls with cavity that after being combined together create a chamber suitable for a specially designed cooler. They have handles for an easy usage.

The cooler is implemented as a liner. The liner is made from a material that is safe for usage and allows easy heat exchange. It is cored and filled with water. Prior to serving the liner needs to be placed in the freezer. After being frozen in the freezer, the ice in the liner will allow to keep the bottles with beverages chilled for continues time The liner slides in between two bottles through its and bottles special constriction. Security is being provided with self-stick tape.

The components of the set are connected together by the use of the strips.

The set occupies very small place. The hidden cooler provides continues cooling, it doesn't interfere with the design of the containers and allows enjoying the overall look of the beverages and their containers.

DETAILED DESCRIPTION OF THE INVENTION

Figure 1:
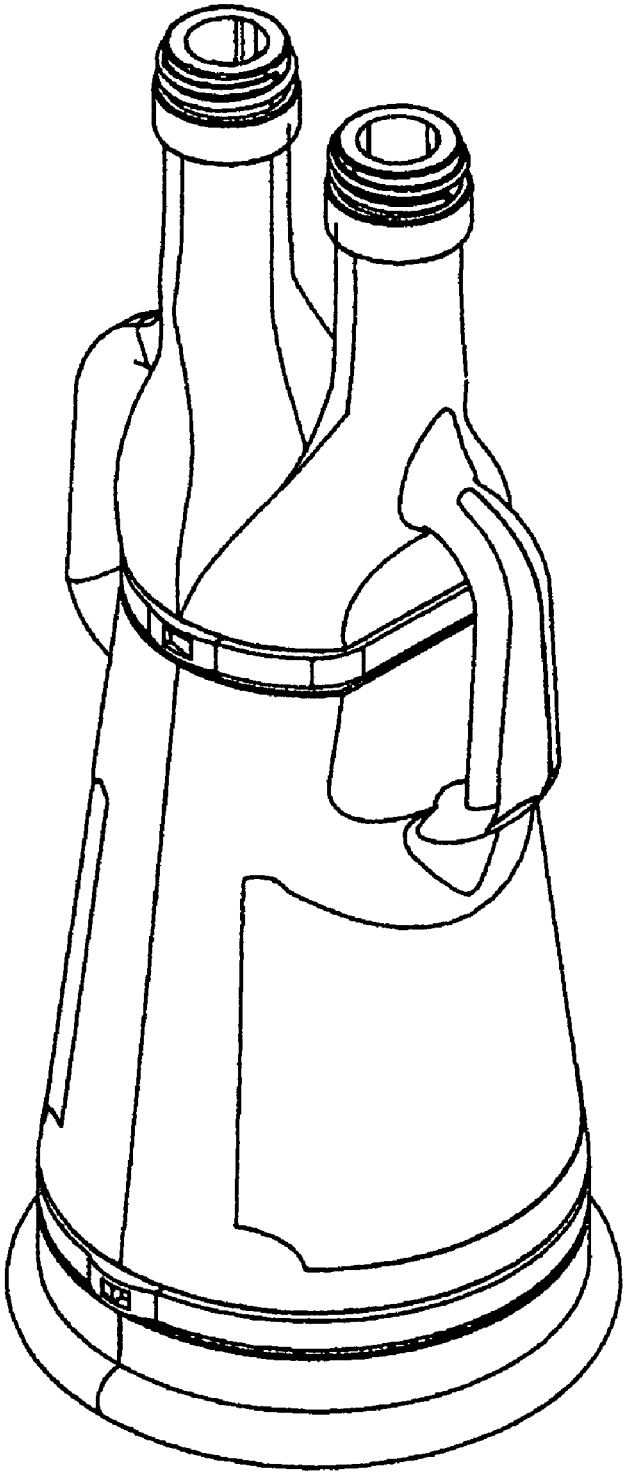
FIG. 1 is a general view of combined bottles with hidden cooler.
Figure 2:
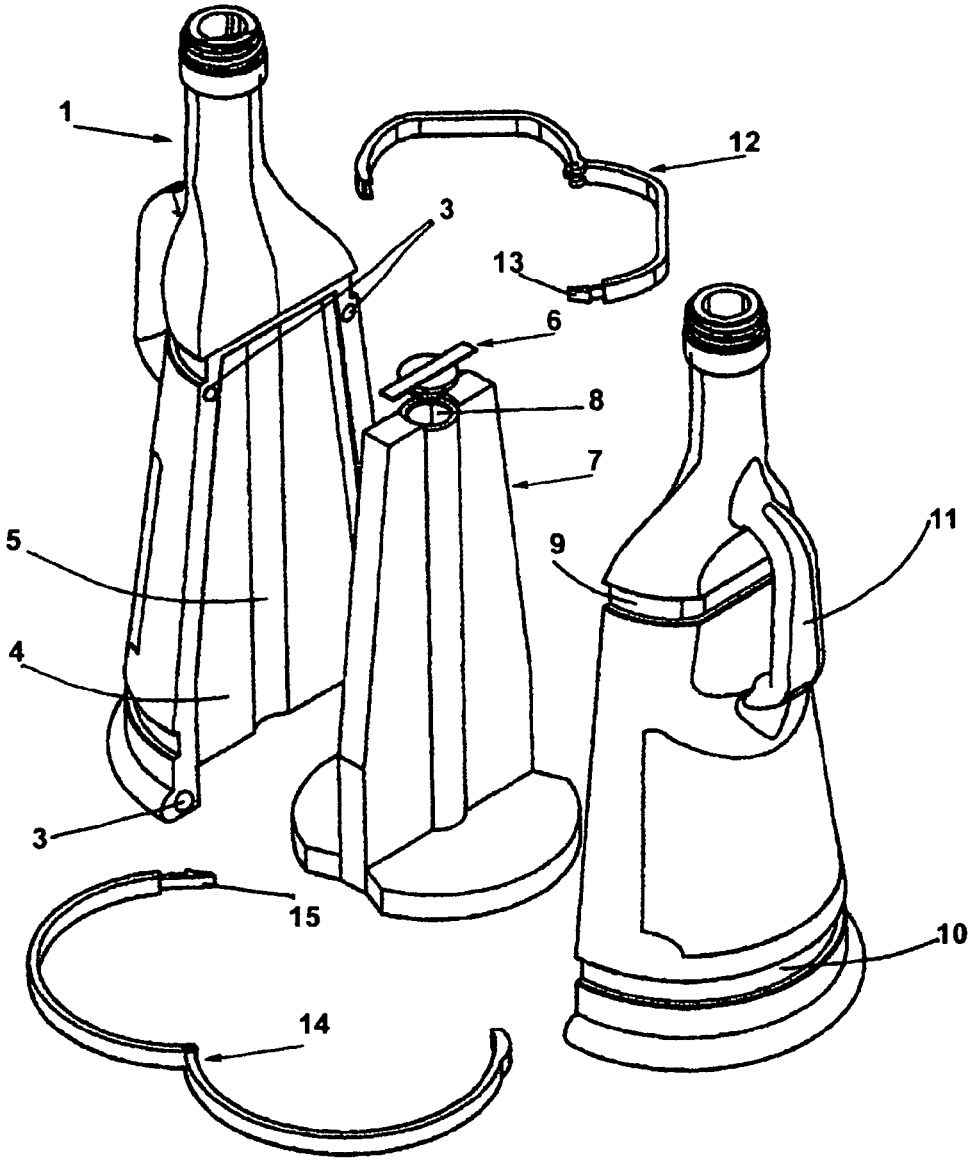
FIG. 2 is the disassembled view of the set.
Figure 3:
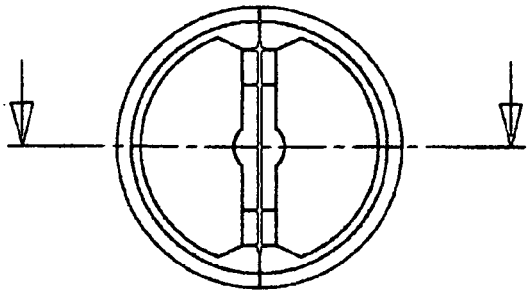
FIG. 3 is the bottom plan view of two interlocked bottles.
Figure 5:
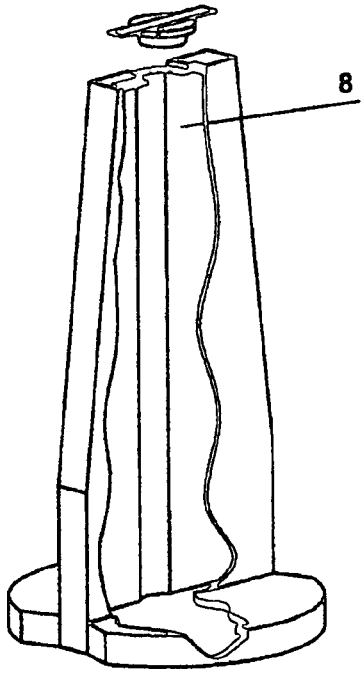
FIG. 5 is the section view of the cooler showing the chamber.
Figure 4:
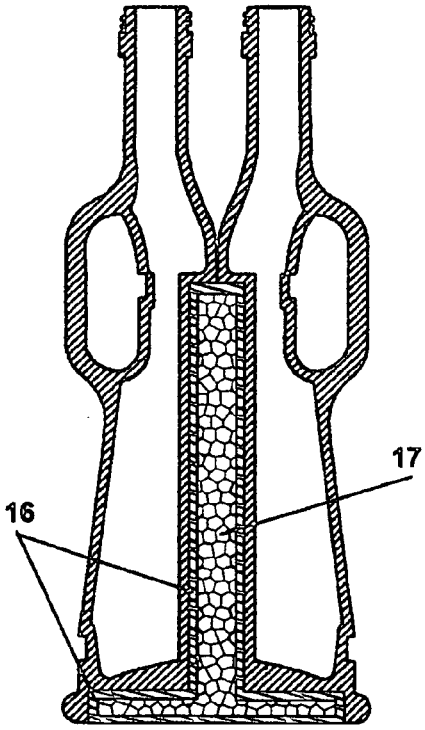
FIG. 4 is the cross-section view of two interlocked bottles with inserted cooler.

For a detailed description we need to refer to the FIG. 2, that presents the components of the set. Backside of the bottle 1 has a cavity 4 with channel 5. Glass bottles 1 and 2 are identical. The cooler 7 has a chamber 8, which will be filled with a refrigerant and a closure 6. When two bottles interlock together, they create a cave, made by cavity 4 located to the backside walls of bottles 1 and 2. Spikes 3 are located on the back wall of the bottle and they prevent the sliding of the bottles. The cooler 7 slides in the cave made by cavity 4. Notches 9 and 10 are made for the plastic straps 12 and 14 that have locks 13 and 15 thereafter. Handle 11 is for easy grip and is also a part of the design of the bottle. FIG. 4 shows cross-section view of two interlocked bottles with inserted cooler, where the ice 17 is trapped between walls of the cooler, marked as 16. FIG. 5 shows the sectional view of the cooler with the chamber 8.

What I claim as my invention is:

1. A thermally-regulated two combined bottles comprising:

a pair of identical bottles where each bottle has a semi-circle cross section whose side wall has cavity where the bottom of said cavity represents semi-cylinder with the height smaller than its diameter, and the upper part of said cavity represents truncated rectangular pyramid with the height shorter than the distance between the bottom of said bottle and the beginning of the cone constituting the bottle's neck;

a container for coolant with a chamber adapted for temperature exchange made from thermally-regulated material;

a recess formed with said cavities of the bottles after combining, being sized and shaped to receive a thermally-regulating coolant container;

a pair of plastic straps with lockers for interlocking said bottles after a set is being combined.

* * * * *